US012122591B2

(12) United States Patent
McAtarian et al.

(10) Patent No.: US 12,122,591 B2
(45) Date of Patent: Oct. 22, 2024

(54) FLEXIBLE INTERMEDIATE BULK CONTAINER WITH COLLECTION SKIRT

(71) Applicant: Andax Industries LLC, Saint Marys, KS (US)

(72) Inventors: Patrick F. McAtarian, St. Marys, KS (US); Mark McAtarian, St. Marys, KS (US)

(73) Assignee: Andax Industries, L.L.C., St. Marys, KS (US)

( * ) Notice: Subject to any disclaimer, the term of this patent is extended or adjusted under 35 U.S.C. 154(b) by 0 days.

(21) Appl. No.: 18/166,362

(22) Filed: Feb. 8, 2023

(65) Prior Publication Data

US 2023/0182995 A1 Jun. 15, 2023

Related U.S. Application Data

(63) Continuation of application No. 17/308,809, filed on May 5, 2021, now abandoned, which is a continuation of application No. 16/026,984, filed on Jul. 3, 2018, now abandoned.

(51) Int. Cl.

| | |
|---|---|
| ***B65D 88/16*** | (2006.01) |
| ***B65B 1/04*** | (2006.01) |
| ***B65B 7/06*** | (2006.01) |

(52) U.S. Cl.

CPC ..... *B65D 88/1681* (2013.01); *B65B 1/04* (2013.01); *B65B 7/06* (2013.01); *B65D 88/1668* (2013.01)

(58) Field of Classification Search

CPC ..... B65D 88/1681; B65D 88/1668; B65D 88/1618; B65D 88/1612; B65D 88/16; B65D 88/54; B65B 1/04; B65B 7/06; B65B 69/0075

USPC ..... 53/469; 383/4, 36

See application file for complete search history.

(56) References Cited

U.S. PATENT DOCUMENTS

| | | | | | |
|---|---|---|---|---|---|
| 375,805 | A * | 1/1888 | Dennis, Jr. | B65D 88/1618 | 383/34.1 |
| 733,542 | A * | 7/1903 | Converse | B65D 88/1618 | 383/17 |
| 1,308,263 | A * | 7/1919 | Smith | B65D 88/1618 | 294/157 |
| 2,073,914 | A * | 3/1937 | Wilfley | B65B 39/08 | 383/12 |
| 3,058,623 | A * | 10/1962 | Hawk | B65D 88/16 | 222/105 |
| 3,550,662 | A * | 12/1970 | Remke | B65D 88/1612 | 383/117 |

(Continued)

*Primary Examiner* — Thomas M Wittenschlaeger
*Assistant Examiner* — Katie L Gerth
(74) *Attorney, Agent, or Firm* — Hovey Williams LLP

(57) ABSTRACT

A collection assembly (10, 10*a*) for flowable materials includes a central, flexible bag (12, 12*a*) with a collection skirt (14, 14*a*) secured to the bag (12, 12*a*) and extending outwardly from the open top (20, 20*a*) of the bag (12, 12*a*). In use, the assembly (10, 10*a*) is placed at a collection site with the bag (12, 12*a*) in a collapsed condition and the skirt (14, 14*a*) is deployed about the bag (12, 12*a*). Material (36) is then placed on the assembly (10, 10*a*) over the open top (20, 20*a*) and, as necessary, the skirt (14, 14*a*). The skirt is then elevated using marginal gathering apparatus (16, 16*a*), thereby causing the material (36) to flow into the bag (12, 12*a*). The skirt (14, 14*a*) may then be gathered and closed, forming a duffel closure for the assembly (10, 10*a*).

31 Claims, 8 Drawing Sheets

(56) References Cited

U.S. PATENT DOCUMENTS 4,200,127 A * 4/1980 Dunleavy ..... B65B 67/1238 141/10
4,471,600 A * 9/1984 Dunleavy ..... B65B 67/1238 53/469
5,069,554 A * 12/1991 Bonnett ..... A47G 11/003 53/413
5,187,823 A * 2/1993 Ferguson ..... A45F 4/06 383/4
5,219,219 A * 6/1993 Virdin, Jr. ..... A47G 11/003 206/541
5,364,188 A * 11/1994 Godfried ..... B65D 75/14 383/4
RE34,849 E * 2/1995 Sanders ..... B65F 1/0006 383/7
5,484,207 A * 1/1996 Schnaars ..... B65D 88/1668 383/73
5,529,393 A * 6/1996 Polett ..... B65D 88/1618 383/41
5,685,644 A * 11/1997 Taylor ..... B65D 88/1618 383/105
5,713,510 A * 2/1998 Walton ..... B65D 25/22 229/117.11
5,722,220 A * 3/1998 Greenland ..... A01G 20/43 229/87.01
5,979,842 A * 11/1999 Fan ..... B65B 67/12 141/391
6,431,753 B1 * 8/2002 Rogers ..... B65D 88/1668 383/41
6,974,783 B2 * 12/2005 Akdogan ..... D03D 15/533 428/397
7,302,978 B1 * 12/2007 Kolarik ..... B65B 67/1205 141/391
7,736,057 B2 * 6/2010 VanBost ..... B65B 67/1238 383/33
8,117,971 B1 * 2/2012 Cotton ..... B65F 1/0006 108/90
8,757,563 B2 * 6/2014 Muse ..... B65B 67/1205 248/97
9,478,322 B1 * 10/2016 Schilling ..... B09B 1/00
10,266,307 B1 * 4/2019 McAtarian ..... B65D 85/30
2001/0032846 A1 * 10/2001 Joshi ..... B65D 88/1668 220/4.13
2002/0074247 A1 * 6/2002 Tremblay ..... B67C 11/02 220/8
2003/0190096 A1 * 10/2003 Miodragovic ..... B65D 33/25 383/4
2004/0120612 A1 * 6/2004 La Fleur ..... B65D 88/1618 383/111
2005/0063623 A1 * 3/2005 Eisenbarth ..... B65D 88/62 383/104
2006/0222270 A1 * 10/2006 Modena ..... B65D 88/1612 383/33
2007/0025646 A1 * 2/2007 Schoenig ..... A45C 13/002 383/4
2007/0127852 A1 * 6/2007 Town ..... B65D 88/1618 383/18
2008/0283524 A1 * 11/2008 Kosich ..... B65D 88/1612 220/9.1
2008/0296195 A1 * 12/2008 Suarez ..... B65D 90/205 206/524.1
2010/0108826 A1 * 5/2010 Fernandez ..... B65F 1/10 248/97
2010/0290887 A1 * 11/2010 Beale ..... B66C 1/226 414/815
2011/0000918 A1 * 1/2011 Plunkett ..... B65D 77/06 220/495.06
2014/0126844 A1 * 5/2014 Lowry ..... B65D 88/1625 383/121.1
2016/0318637 A1 * 11/2016 Beale ..... B65B 1/04
2017/0096296 A1 * 4/2017 Lawrence ..... B65D 90/047
2018/0086492 A1 * 3/2018 Weathers ..... B65F 1/10
2018/0155118 A1 * 6/2018 Tucker ..... B32B 3/08

* cited by examiner

FLEXIBLE INTERMEDIATE BULK CONTAINER WITH COLLECTION SKIRT

CROSS REFERENCE TO RELATED APPLICATIONS

This application is a continuation of and claims priority to U.S. patent application Ser. No. 17/308,809, filed May 5, 2021, which is a continuation of U.S. patent application Ser. No. 16/026,984, filed Jul. 3, 2018, each of which is incorporated herein by reference in its entirety.

BACKGROUND OF THE INVENTION

Field of the Invention

The present invention is concerned with container assemblies for a variety of materials, especially particulate solid materials such as contaminated earth. More particularly, the invention is concerned with such container assemblies which may be flexible intermediate bulk containers (FIBCs), characterized by the provision of a central flexible bag for the materials, with a surrounding collection skirt allowing easy bag filling and closure of the assemblies.

Description of the Prior Art

A flexible intermediate bulk container, also referred to as a "bulk bag" or a "big bag," is an industrial container made of flexible material that is designed for storing and transporting dry, flowable products, such as earth, sand, fertilizer, and plastic granules. A variety of FIBC designs have been proposed in the past, which are typically differentiated by the bag bottom wall, which may be plain or equipped with various types of closures or discharge spouts. In general, these bags are used by deployment thereof in an open-top unfilled condition, followed by depositing the desired material into the bag structure. These types of designs suffer from the fact that extraneous material will often flow past the bag opening and collect as spillage on the ground or other support surface. This is particularly troublesome where contaminated materials, such as soils, are to be bagged and transferred.

U.S. Pat. No. 5,967,579 discloses an "industrial diaper" for use in controlling spills from damaged FIBCs. As illustrated in FIG. 1 of the drawings, a cruciform-shaped sheet having a central opening 16 and four outwardly extending panels 14 is illustrated. As seen in FIGS. 3 and 4, the sheet is laid on the ground or other surface, and a damaged FIBC is placed thereon, with the outlet 38 of the FIBC extending through the opening 16. Thereupon, the four panels 14 are drawn upwardly and attached together.

U.S. Pat. No. 7,736,057 discloses a leaf bag having a standard upright rectangular bag 102 with a funnel construction extending upwardly and outwardly from the upper margins of the bag. As disclosed, the funnel is designed to facilitate loading of the bag 102. However, the bag 102 is not collapsible and the funnel structure is not designed to lay flat on the ground.

U.S. Pat. No. 7,219,705 discloses a leaf bag system for use with a receptacle, such as a waste can. The '705 bag provides a funnel-like structure which can be secured to the upper end of the can to allow filling thereof with leaves.

Additional references include: U.S. Pat. Nos. 3,374,929, 3,893,595, 4,364,424, 4,603,432, 5,529,393, 5,685,644, 6,431,753, 6,938,860, 6,974,783, 8,070,006, and 8,161,676; US Patent Publications Nos. 2011/0044564, 2016/0264805, and 2017/0043946; Foreign Patent References Nos. EP2570353B1, WO1994019259 and WO07108833; and three non-patent literature references: BAGCORP Product Descriptions, 2018, found online at www.bagcorpstore.com/Duffle-Top_c_150.html; Sinopack Product Descriptions, 2018, found online at sinopack.en.made-in-china.com/product/zy/KxSQ1PgVhY/China-Circular-Big-Bag-; and SSANGLEONG BULKHANDLING article "SSuper Sack," 2018, found online at http://www.ssangleong.com/index.php?route=information/information&information_id=19.

SUMMARY OF THE INVENTION

The present invention overcomes the problems outlined above and provides container assemblies for materials generally comprising a flexible bag including an open top and presenting a periphery, sidewall structure, and a bottom wall. The bag is movable between a collapsed position when unfilled with material, and an expanded position when material is placed therein. The overall assemblies also include a flexible collection skirt secured to the bag adjacent the open top thereof and extending outwardly therefrom and around the periphery of the open top. The collection skirt has an outer margin and gathering apparatus at spaced locations adjacent the outer margin in order to permit gathering of the skirt during filling of the bag with material and consequent movement of the bag to the expanded position thereof.

In order to provide adequate protection against material spillage, the area of the surrounding skirt is greater than the area of the open top of the bag. In an embodiment, the outer margin of the skirt may be substantially circular, but this is in no way required; indeed, the skirt can assume any desired shape so long as it surrounds the open top of the bag and provides adequate area for preventing material spillage. Gathering apparatus is also provided for the skirt, which may be in the form of a plurality of circumferentially spaced apart lifting loops secured to the outer margin of the skirt; alternately, a drawstring-type gathering apparatus may be used.

In addition, the central bag is advantageously equipped with a plurality of exterior lifting points located about the periphery of the top of the bag. In order to accommodate the bag, the skirt has a central opening in the shape of the bag and a plurality of connection segments adjacent this central opening in order to permit attachment of the bag top to these segments.

The bag and skirt are preferably formed of flexible synthetic resin material, but other types of flexible material, such as canvas, could be used.

In the use of the container assemblies of the invention, the latter are deployed on the ground or other support surface by maintaining the bag in a collapsed position with the skirt extending outwardly therefrom in an essentially lay-flat configuration. Thereupon, the material to be bagged is deposited in the central region of the assembly over the open top of the bag and, as necessary, on the skirt near the bag. Next, the skirt gathering apparatus is used to lift the outer margin of the skirt in order to elevate the assembly. This causes flow of the material into the bag in order to fill it, with the gathered skirt above the bag opening. This gathered skirt can then be tied off or otherwise closed to create a duffel top. The now-exposed bag lifting points are then used to lift the filled and closed container for transport of the collected material.

BRIEF DESCRIPTION OF THE DRAWINGS

While the drawings do not necessarily provide exact dimensions or tolerances for the illustrated components or structures, FIGS. 1-10 are to scale with respect to the relationships between the components of the structures illustrated therein.

DETAILED DESCRIPTION OF THE PREFERRED EMBODIMENTS

Figure 1:
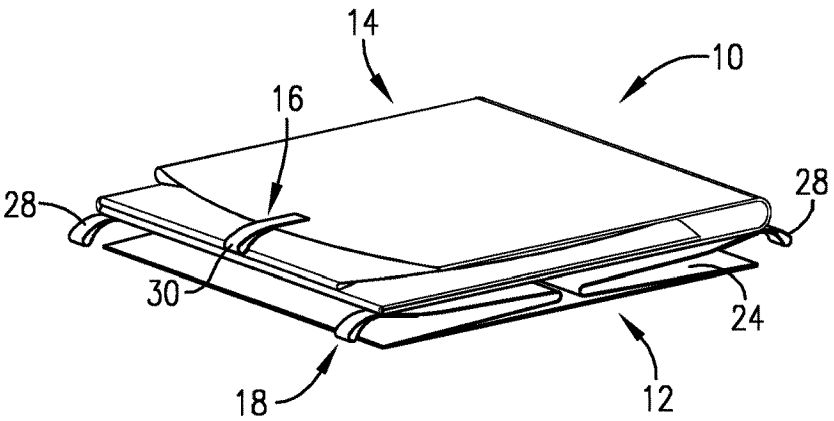
FIG. 1 is a perspective view of a container assembly in accordance with the invention, shown in a collapsed, folded-up configuration prior to use of the assembly.

Turning now to FIGS. 1-4, a FIBC-type container assembly 10 is depicted, which generally includes a central flexible bag 12 and a surrounding, flexible skirt 14, the latter equipped with gathering apparatus 16 at spaced locations adjacent the outer margins of the skirt, and with lifting points 18 secured to the exterior of bag 12 adjacent the upper margins thereof. The bag 12 includes an open top 20 presenting a periphery 22, as well as sidewall structure 24, and a bottom wall 26. The bag is designed to move between a collapsed, folded-up configuration, illustrated in FIGS. 1-3, and an expanded position shown in FIG. 4.

Figure 2:
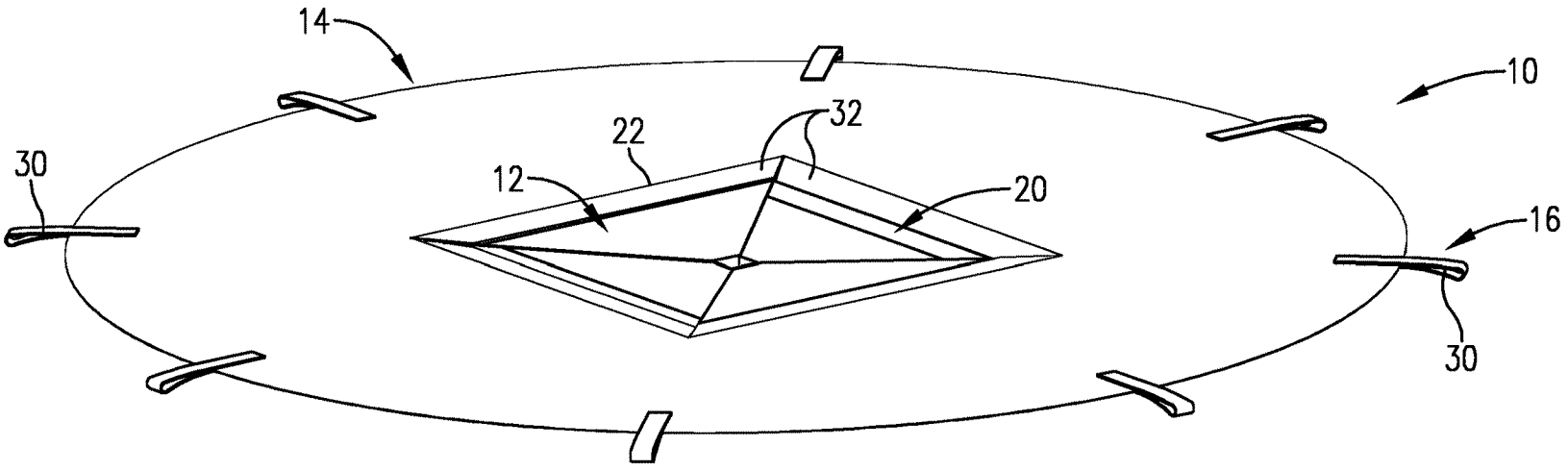
FIG. 2 is a top perspective view of the container assembly lying on a support surface prior to filling of the container assembly.
Figure 3:
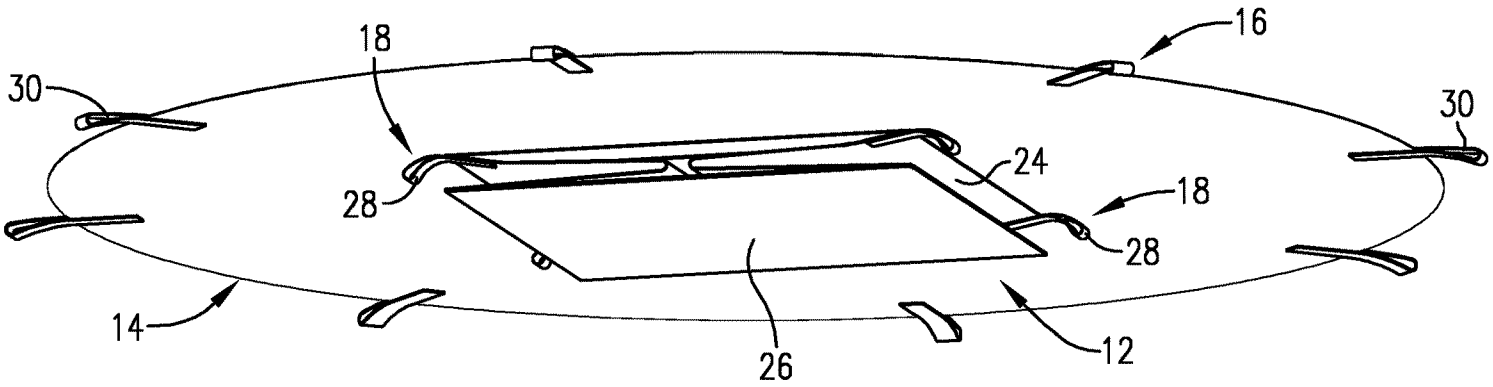
FIG. 3 is a bottom perspective view of the container assembly illustrated in FIG. 2.

In more detail, in the illustrated embodiment, the bag 12 is of quadrate configuration in plan with foldable sidewall structure 24 and a planar bottom wall 26. As shown in FIGS. 1-3, the bag 12 is initially in its folded-up configuration below the skirt 14. Of course, the bag may be of any other desired shape (e.g., cylindrical or octagonal), and the size thereof is limited only by design considerations for the intended use of the assembly 10. The lifting points 18 are in the form of welded or sewn loops 28, which are secured to the sidewall structure 24 adjacent the open top 20.

The skirt 14 completely surrounds the bag 12, which is important for purposes to be described, and has a central opening 29 for accommodating the bag 12. As depicted, the gathering apparatus 16 includes a series of pickup loops 30 secured by welding or stitching to the outer margin of the skirt at circumferentially spaced locations. Again, while the skirt 14 is depicted as being substantially circular at its outer margin, any number of skirt shapes could be used.

Figure 4:
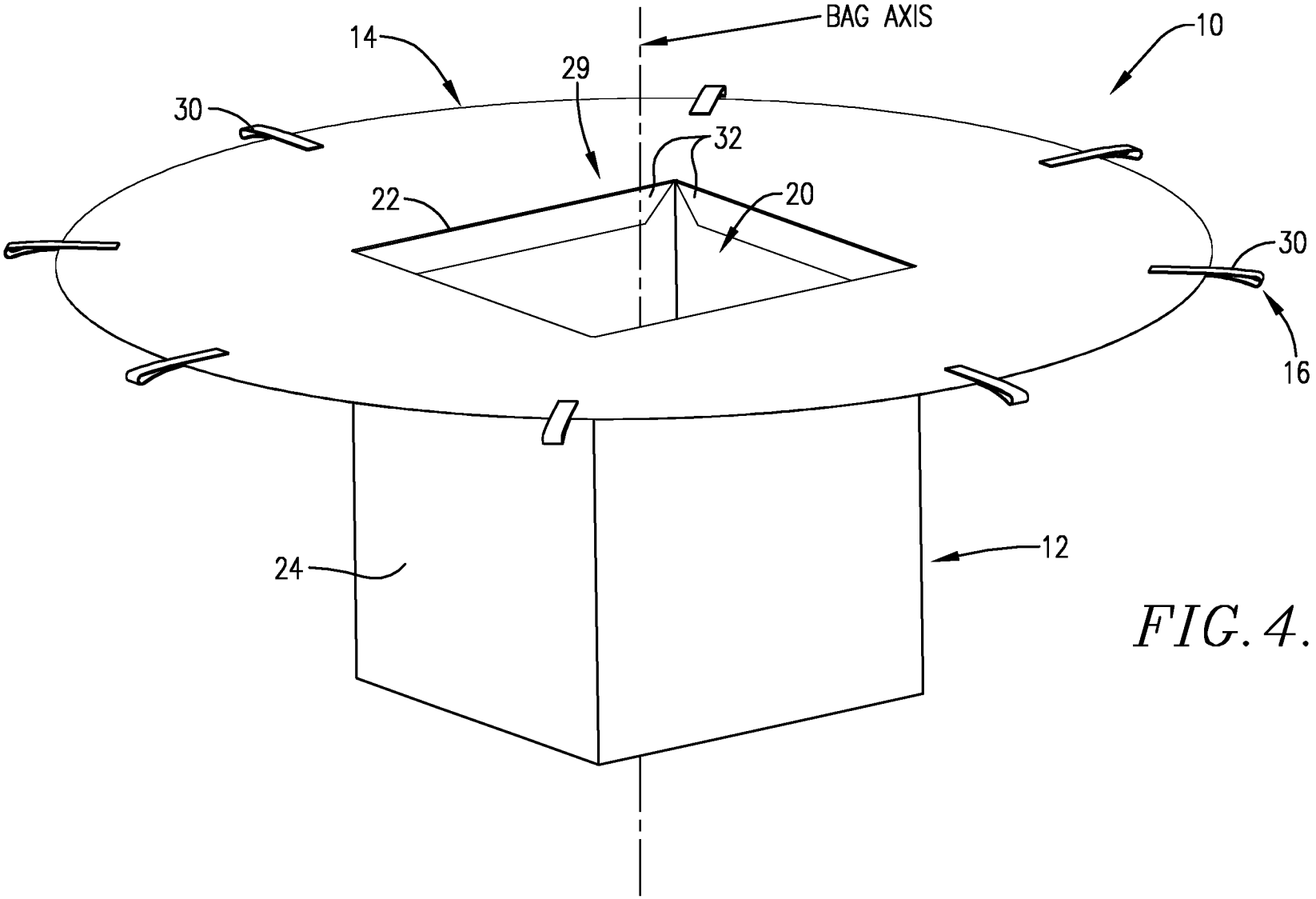
FIG. 4 is a top perspective view of the container assembly, shown with the central bag thereof in a deployed position.
Figure 5:
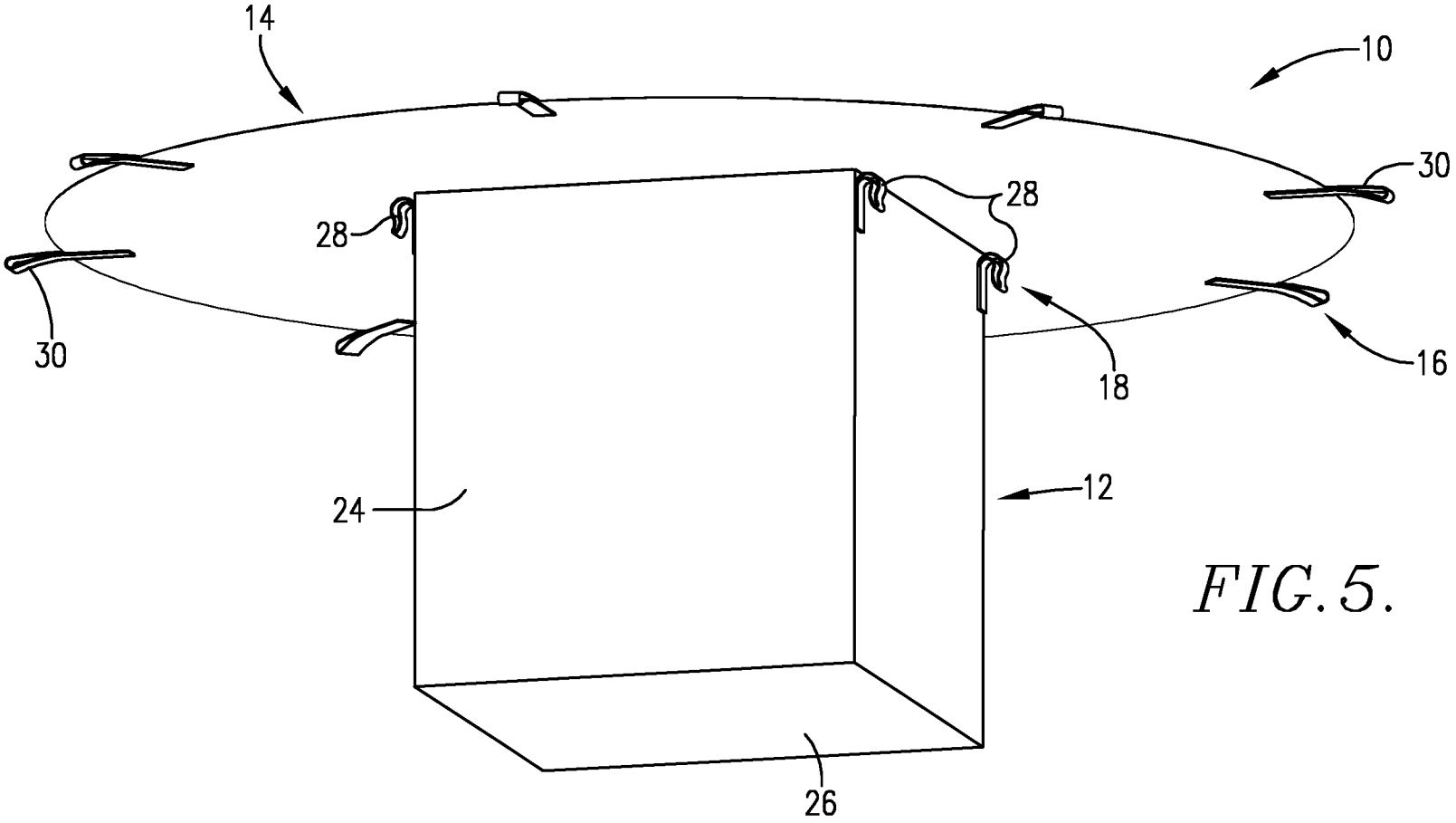
FIG. 5 is a bottom perspective view of the container assembly illustrated in FIG. 4.
Figure 6:
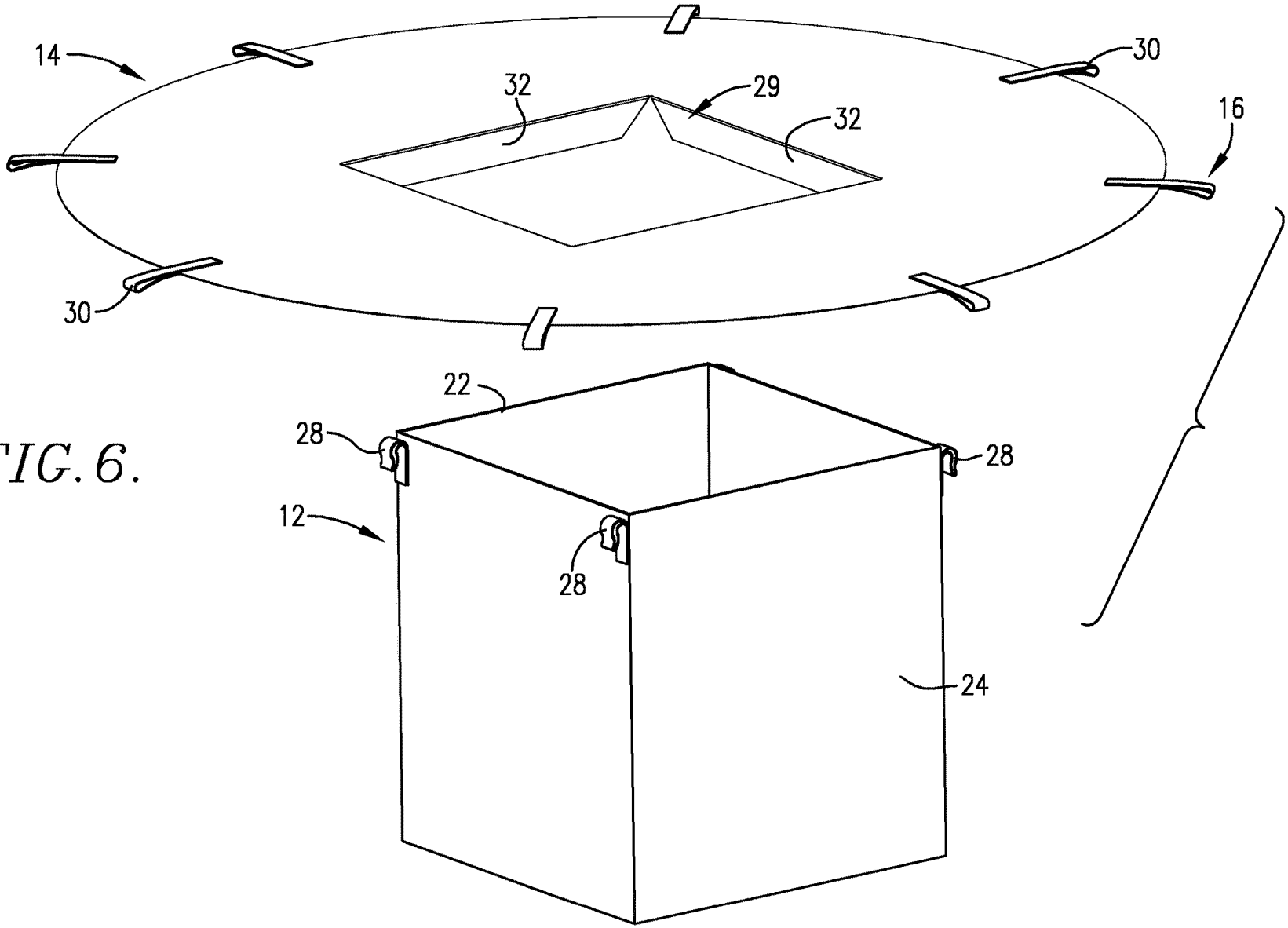
FIG. 6 is a top perspective exploded view of the container assembly.
Figure 7:
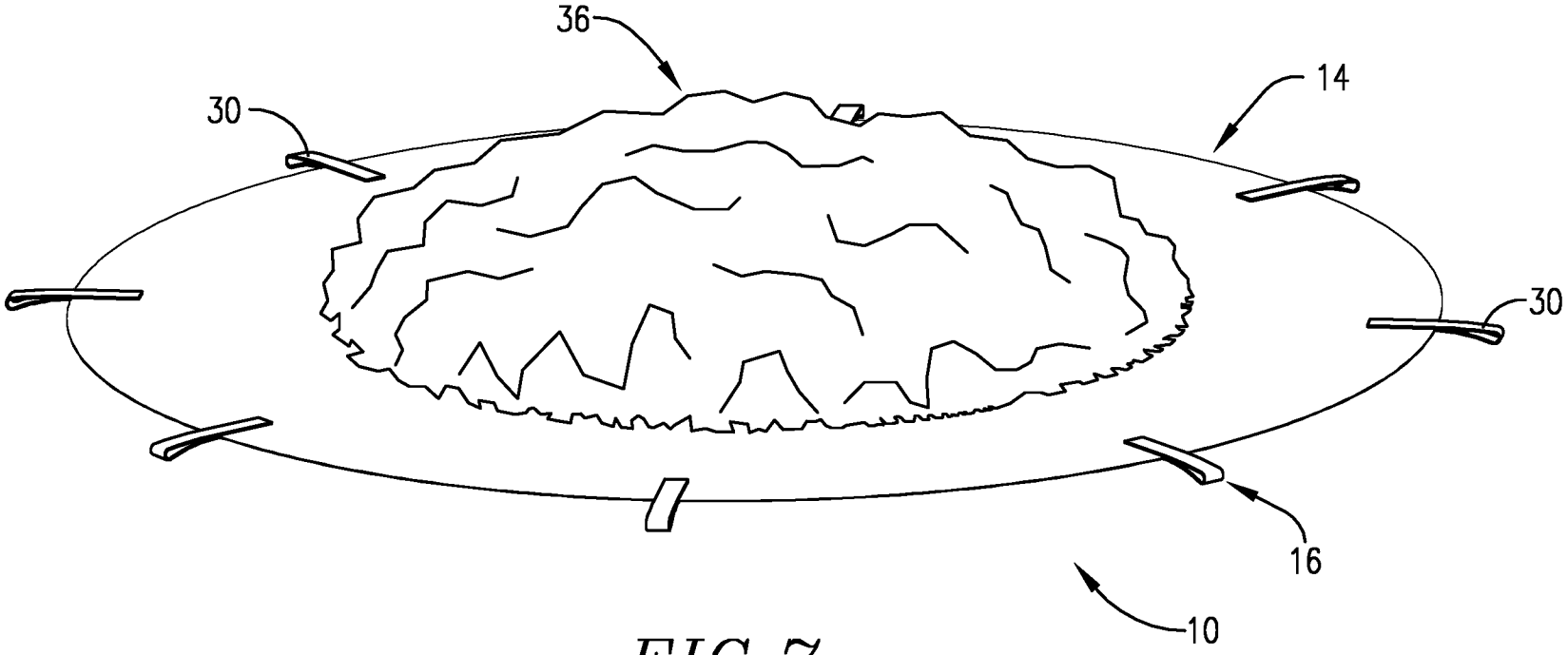
FIG. 7 is a top perspective view of the container assembly, in a collapsed condition, but with fill applied in the central region of the container assembly.

In order to properly secure the bag 12 to skirt 14, the latter is equipped with a series of connection segments 32 at the region of opening 29 (see FIGS. 4 and 6). The segments 34 are attached by any convenient means to the upper margin of sidewall structure 24, in order to afford a secure connection between the bag 12 and the skirt 14.

Figure 9:
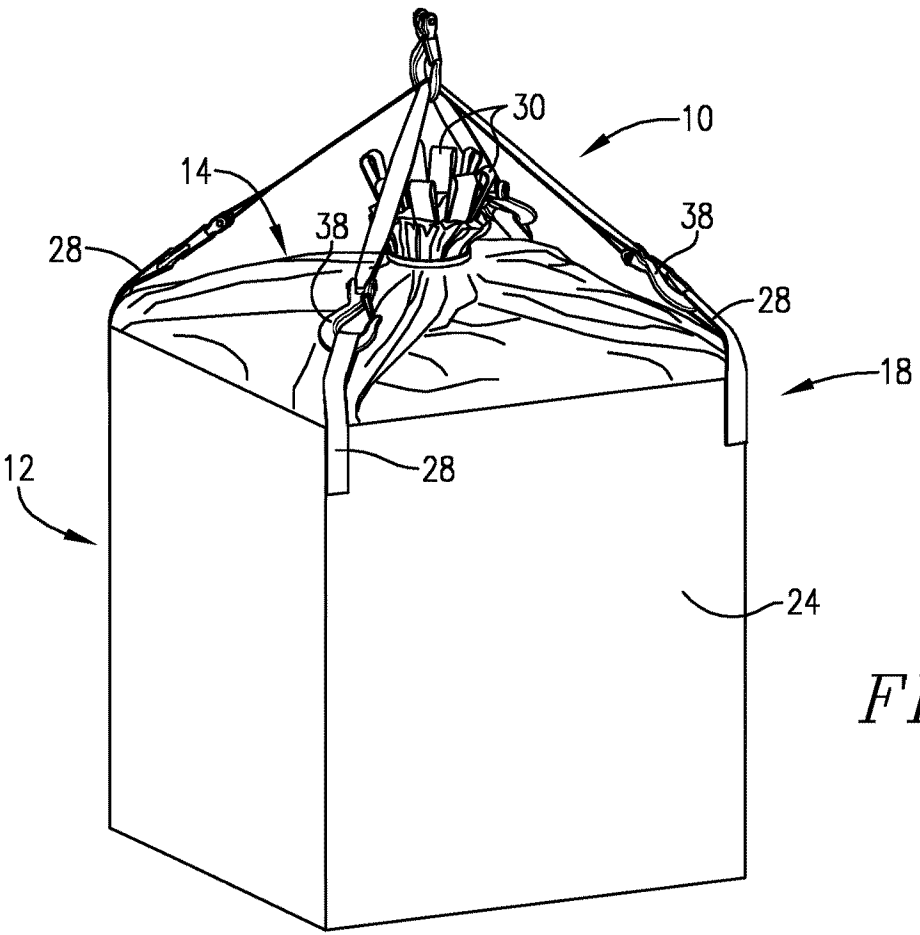
FIG. 9 is a perspective view of the container assembly after complete filling and closure thereof, and depicting elevation of the container assembly.

As illustrated in FIG. 1, during storage the assembly 10 is completely folded up, i.e., the bag 12 is in its collapsed position and the skirt 14 is folded over the bag 12. However, when it is desired to use the assembly 10, the skirt 14 is unfolded and laid upon the ground or other support surface, with the bag 12 still in its collapsed position (FIGS. 2-3). FIG. 6 illustrates a condition where a particulate material 36, such as contaminated soil, is placed upon the assembly 10 over the open top 20 of bag 12 and, to the extent necessary, onto the skirt 14. Once the material is so placed, lifting cable grappling hooks 38 are coupled with the loops 30 and these are pulled upwardly. As this occurs, the bag 12 is deployed downwardly under the weight of the material 36, until the bag 24 is completely filled (FIG. 8), with any additional fill piled above the open top 20, but still within the confines of the skirt 14. Finally, the skirt 14, now in a drawn-together configuration, is closed using a tie or the like (FIG. 9). This exposes the lifting points 18 allowing further use of the grappling hooks to lift and convey the closed container assembly for disposal as necessary of the material 36.

Figure 8:
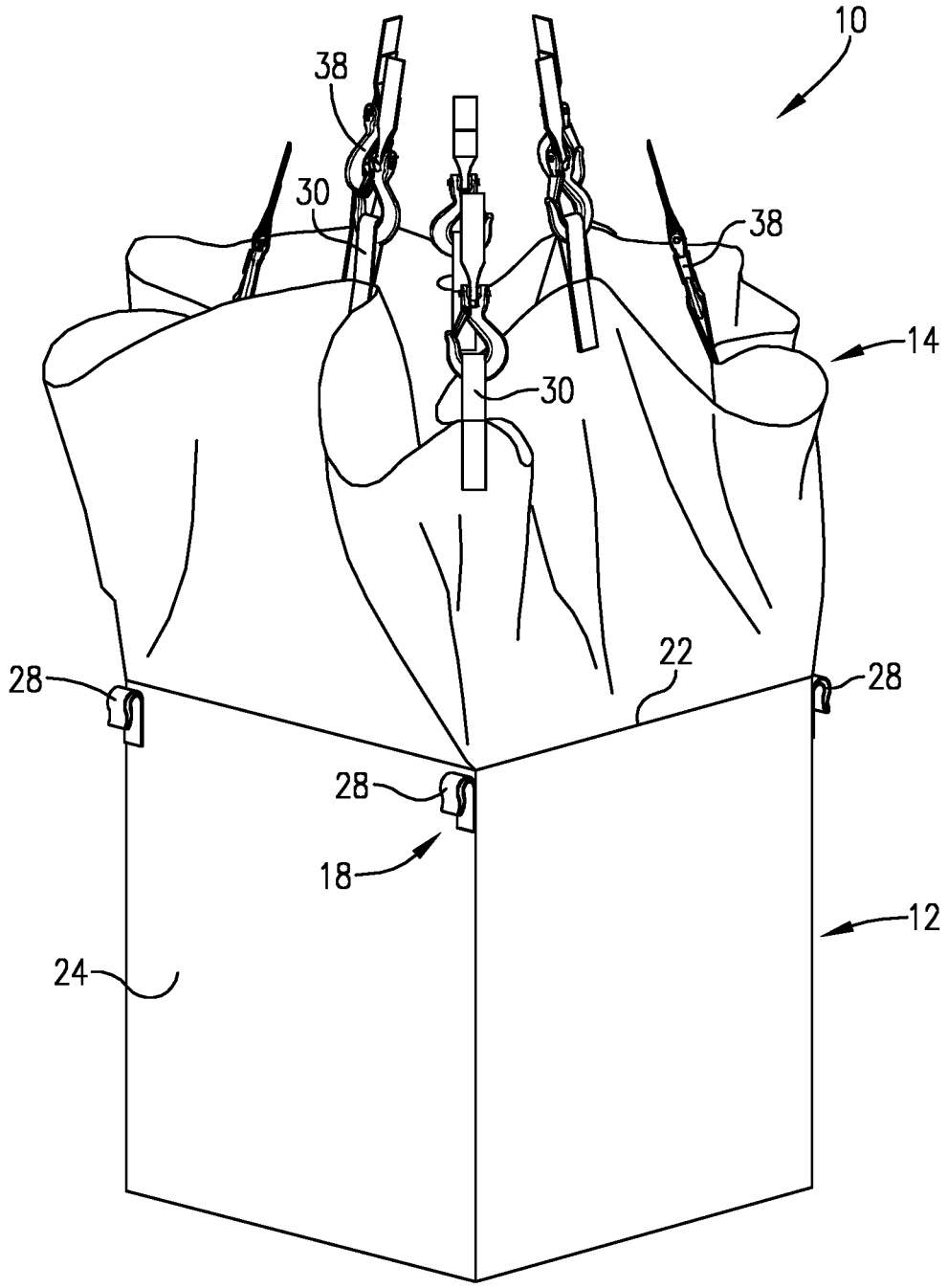
FIG. 8 is a perspective view illustrating the container assembly of FIG. 7 during elevation of the skirt of the assembly during filling of the central bag thereof.
Figure 10:
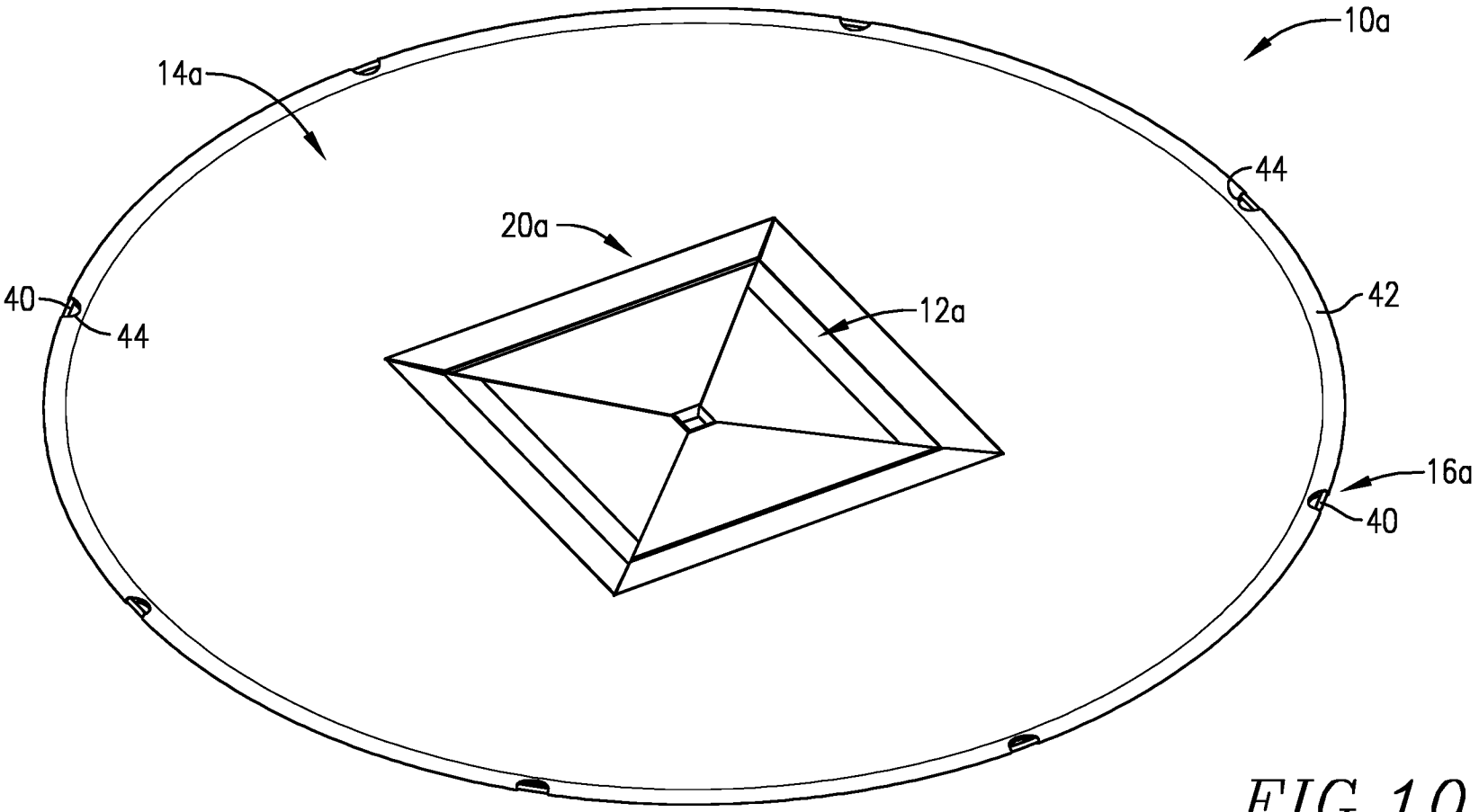
FIG. 10 is a top perspective view similar to that of FIG. 2, illustrating another embodiment of the invention making use of a drawstring-type peripheral gathering apparatus.

FIG. 10 depicts another embodiment of the invention in the form of an assembly 10*a*, which is identical in many respects to the assembly 10. Accordingly, like reference numerals will be used to describe the assembly 10*a*, with the addition of the letter identifier "a." Specifically, the assembly 10 a has a central, flexible bag 12*a* and a surrounding flexible skirt 14*a*, the latter equipped with gathering apparatus 16*a*, here including a peripheral, continuous drawstring in the form of a cable 40, which is captively retained within a pocket 42 extending about the outer margin of skirt 14*a*. As illustrated, the pocket 42 has a plurality of openings 44 formed therein which are circumferentially spaced about the pocket. The openings 44 allow access to the drawstring cable 40 when it is desired to lift and elevate the skirt 14*a*. For example, and as depicted in FIG. 8, cable grappling hooks 38 may be secured to the drawstring cable 40 at the openings 44. Elevation of the hooks 38 causes the skirt 14*a* to be drawn upwardly into the general shape of a column, which can then be tied off as described.

In some instances, the flexible bags of the container assemblies of the invention may be equipped with waterproof liners, formed of an appropriate material, such as polyethylene, to prevent leakage of liquids.

We claim:

1. A method of collecting a flowable material, said method comprising the steps of:

(a) placing a container assembly on a support surface, said container assembly including a flexible bag defining a bag interior and a flexible collection skirt secured to the bag, said bag being in a collapsed configuration and said skirt being in a flat configuration during the course of step (a), such that a lower face of the skirt and a bottom wall of the bag are closely adjacent one another and the lower face of the skirt and the bottom wall of the bag are each supported by the support surface, said bag interior presenting an open bag top defining a periphery, said skirt secured to the bag at the periphery and extending outwardly therefrom, said skirt presenting a central skirt opening at the periphery, such that the central skirt opening and the open bag top are at least substantially congruent;

(b) depositing a quantity of the flowable material onto the container assembly such that the quantity of flowable material is disposed over the open bag top;

(c) after step (b), gathering the skirt such that an outer margin of the skirt shifts inward toward an upright axis of the bag; and (d) lifting the skirt to facilitate shifting of the bag from the collapsed configuration to an expanded configuration and passage of the quantity of flowable material from said central skirt opening and said open bag top into the bag interior, said central skirt opening and said open bag top each maintaining an at least substantially constant shape and size at the completion of step (a) and after completion of step (d).

2. The method of claim 1, further comprising the step of:

(e) depositing a secondary quantity of flowable material onto an upper face of the skirt, said secondary quantity of flowable particulate material being directed toward the central skirt opening and the open bag top during the course of step (c) and passing into the bag interior during the course of step (d).

3. The method of claim 2, steps (b) and (e) occurring simultaneously.

4. The method of claim 1, steps (c) and (d) occurring simultaneously.

5. The method of claim 1, said bag including a foldable sidewall projecting from the bottom wall, said bottom wall and said foldable sidewall at least in part defining the bag interior, said sidewall being folded during steps (a) and (b) and unfolding during step (d).

6. The method of claim 1, said bottom wall of the bag being spaced from the lower skirt face a greater distance when the bag is in the expanded configuration than when the bag is in the collapsed configuration.

7. The method of claim 1, further comprising the step of:

(f) lifting the container assembly to elevate the container assembly and the quantity of material contained therein relative to the support surface.

8. The method of claim 7, said bag including lifting structures, step (f) including the step of using the lifting structures to lift the container assembly and the flowable material therein.

9. The method of claim 8, said lifting structures being concealed below the lower face of the skirt during steps (a) and (b)

said lifting structures being revealed during the course of step (c).

10. The method of claim 8, said lifting structures being secured to the bag adjacent the periphery of the open bag top.

11. The method of claim 1, further comprising the step of:

(g) closing said skirt, step (g) occurring after completion of step (c).

12. The method of claim 11, step (g) including the step of cinching the skirt.

13. The method of claim 11, said skirt including a drawstring for cinching the skirt.

14. The method of claim 1, said skirt including a gathering apparatus, said gathering apparatus including a plurality of gathering loops disposed at spaced locations adjacent the outer margin, step (c) including the step of shifting the gathering loops toward the upright axis of the bag, such that the gathering loops are clustered about the upright axis of the bag.

15. The method of claim 1, said skirt lying in a plane at least substantially orthogonal to the upright axis of the bag when the skirt is in the flat configuration.

16. The method of claim 1, said outer margin of the skirt being substantially circular.

17. The method of claim 1, said bag open top having a bag open top area, said skirt having a skirt area that is greater than said bag open top area.

18. The method of claim 1, said bag interior presenting a constant bag interior cross-section when the bag is in the expanded configuration, said bag interior cross-section being at least substantially congruent with each of said bag open top and said central skirt opening after completion of step (d).

19. The method of claim 18, said bag open top and said central skirt opening each being rectangular in cross-sectional shape both at the completion of step (a) and after completion of step (d), said bag being quadrate in plan, with the bag interior being rectangular in cross-sectional shape when the bag is in the expanded configuration.

20. The method of claim 1, said skirt including a plurality of connection segments adjacent the central skirt opening, said connection segments being attached to the bag.

21. A method of collecting a flowable material, said method comprising the steps of:

(a) placing a container assembly on a support surface, said container assembly including a flexible bag defining a bag interior and a flexible collection skirt secured to the bag, said bag being in a collapsed configuration and said skirt being in a flat configuration during the course of step (a), such that a lower face of the skirt and a bottom wall of the bag are closely adjacent one another and the lower face of the skirt and the bottom wall of the bag are each supported by the support surface, said bag interior presenting an open bag top defining a periphery, said skirt secured to the bag at the periphery and extending outwardly therefrom, said skirt presenting a central skirt opening at the periphery, such that the central skirt opening and the open bag top are at least substantially congruent;

(b) depositing a quantity of the flowable material onto the container assembly such that the quantity of flowable material is disposed over the open bag top;

(c) after step (b), gathering the skirt such that an outer margin of the skirt shifts inward toward an upright axis of the bag; and (d) lifting the skirt to facilitate shifting of the bag from the collapsed configuration to an expanded configuration and passage of the quantity of flowable material from said central skirt opening and said open bag top into the bag interior, said bag interior presenting a constant bag interior cross-section when the bag is in the expanded configuration, with said bag interior cross-section being at least substantially congruent with each of said bag open top and said central skirt opening after completion of step (d).

22. The method of claim 21, further comprising the step of:

(e) depositing a secondary quantity of flowable material onto an upper face of the skirt, said secondary quantity of flowable particulate material being directed toward the central skirt opening and the open bag top during the course of step (c) and passing into the bag interior during the course of step (d).

23. The method of claim 22, steps (b) and (e) occurring simultaneously.

24. The method of claim 21, steps (c) and (d) occurring simultaneously.

25. The method of claim 21, said bag including a foldable sidewall projecting from the bottom wall, said bottom wall and said foldable sidewall at least in part defining the bag interior, said sidewall being folded during steps (a) and (b) and unfolding during step (d).

26. The method of claim 21, further comprising the step of:

(f) lifting the container assembly to elevate the container assembly and the quantity of material contained therein relative to the support surface.

27. The method of claim 21, further comprising the step of:

(g) closing said skirt, step (g) occurring after completion of step (c).

28. The method of claim 21, said skirt including a gathering apparatus, said gathering apparatus including a plurality of gathering loops disposed at spaced locations adjacent the outer margin, step (c) including the step of shifting the gathering loops toward the upright axis of the bag, such that the gathering loops are clustered about the upright axis of the bag.

29. The method of claim 21, said bag open top having a bag open top area, said skirt having a skirt area that is greater than said bag open top area.

30. The method of claim 21, said bag open top and said central skirt opening each being rectangular in cross-sectional shape both at the completion of step (a) and after completion of step (d), said bag being quadrate in plan, with the bag interior being rectangular in cross-sectional shape when the bag is in the expanded configuration.

31. The method of claim 21, said skirt including a plurality of connection segments adjacent the central skirt opening, said connection segments being attached to the bag.

* * * * *